US012053665B2

(12) United States Patent
DeForest, Jr.

(10) Patent No.: US 12,053,665 B2
(45) Date of Patent: Aug. 6, 2024

(54) HUMAN POWERED STRENGTHENING MACHINE

(71) Applicant: D Curtis DeForest, Jr., East Hampton, NY (US)

(72) Inventor: D Curtis DeForest, Jr., East Hampton, NY (US)

( * ) Notice: Subject to any disclaimer, the term of this patent is extended or adjusted under 35 U.S.C. 154(b) by 40 days.

(21) Appl. No.: 15/707,836

(22) Filed: Sep. 18, 2017

(65) Prior Publication Data

US 2022/0001232 A1 Jan. 6, 2022

(51) Int. Cl.

| | |
|---|---|
| ***A63B 22/00*** | (2006.01) |
| ***A63B 21/00*** | (2006.01) |
| ***A63B 21/22*** | (2006.01) |
| ***A63B 22/06*** | (2006.01) |

(52) U.S. Cl.

CPC ..... *A63B 22/001* (2013.01); *A63B 21/154* (2013.01); *A63B 21/225* (2013.01); *A63B 21/4034* (2015.10); *A63B 21/4035* (2015.10); *A63B 22/0005* (2015.10); *A63B 22/0605* (2013.01); *A63B 22/0694* (2013.01); *A63B 2022/0043* (2013.01); *A63B 2022/0611* (2013.01); *A63B 2225/09* (2013.01)

(58) Field of Classification Search

CPC ... A63B 22/001; A63B 22/0012; A63B 22/06; A63B 22/0605–0694; A63B 2022/06; A63B 2022/0605; A63B 2022/0611–0658

See application file for complete search history.

(56) References Cited

U.S. PATENT DOCUMENTS

| | | | | | |
|---|---|---|---|---|---|
| 1,820,372 | A | * | 8/1931 | Blomquist | A63B 22/001 482/62 |
| 2,020,992 | A | * | 11/1935 | Caplan | A61H 1/0214 601/32 |
| 3,213,852 | A | * | 10/1965 | Zent | A63B 22/001 601/36 |
| 3,572,699 | A | * | 3/1971 | Nies | A61B 5/221 482/5 |
| 3,930,495 | A | * | 1/1976 | Marino, Jr. | A61H 1/0214 601/36 |
| 4,071,235 | A | * | 1/1978 | Zent | A63B 22/001 482/62 |

(Continued)

FOREIGN PATENT DOCUMENTS

GB 2380419 A * 4/2003 ..... A63B 21/0051

*Primary Examiner* — Nyca T Nguyen

(74) *Attorney, Agent, or Firm* — Cowan, Liebowitz & Latman, P.C.; Mark Montague; Fei Xing

(57) ABSTRACT

A standing exercise device includes a base, a foot pedal assembly mounted to the base, a first member pivotally coupled to the foot pedal assembly, a second member extending upwardly from the first member, a hand pedal assembly mounted to the second member, a third member coupled to the foot pedal assembly and the hand pedal assembly, and an interlocking hinge pivotally connecting the first and second members. The interlocking hinge is movable relative to the foot pedal assembly to vertically adjust a position of the hand pedal assembly. The first, second, and third members together form an adjustable frame defining a space configured to receive and support a user in a standing position with the user's hands and feet respectively engaging and manually driving a pair of hand pedals and a pair of foot pedals in synchronous circular motion.

15 Claims, 5 Drawing Sheets

(56) References Cited

U.S. PATENT DOCUMENTS 4,222,376 A * 9/1980 Praprotnik ..... A61H 1/0214 482/60
4,402,502 A * 9/1983 Peters ..... A61H 1/0214 482/139
4,519,604 A * 5/1985 Arzounian ..... A63B 22/0087 482/133
4,521,012 A * 6/1985 Cosby ..... A63B 22/0002 482/112
4,582,318 A * 4/1986 Giannelli ..... A63B 21/154 280/261
4,846,156 A * 7/1989 Kopnicky ..... A61H 1/0214 601/36
4,881,732 A * 11/1989 Kepiro ..... A63B 22/0605 482/64
D305,347 S * 1/1990 Wittenbrock ..... A63B 21/4035 D21/665
5,330,402 A * 7/1994 Johnson ..... A63B 22/0012 482/52
5,336,147 A * 8/1994 Sweeney, III ..... A63B 22/0012 482/57
5,342,262 A * 8/1994 Hansen ..... A63B 22/0605 482/62
5,595,554 A * 1/1997 Maresh ..... A63B 21/157 482/52
5,989,162 A * 11/1999 Daniels ..... A63B 22/0694 482/62
6,036,623 A * 3/2000 Mitchell ..... A63B 23/03575 482/57
6,840,892 B1 * 1/2005 Wu ..... A63B 22/0005 482/51
7,429,055 B2 * 9/2008 DeForest, Jr. ..... B62M 1/12 280/281.1
7,625,318 B1 * 12/2009 Heyn ..... A63B 21/4013 482/100
D714,405 S * 9/2014 Thorn ..... A63B 21/154 D21/665
9,643,041 B2 * 5/2017 Neill ..... A63B 21/0088
2001/0029222 A1 * 10/2001 Taggett ..... A63B 21/0055 482/57
2006/0003871 A1 * 1/2006 Houghton ..... A63B 22/0605 482/57
2007/0129219 A1 * 6/2007 Mahlberg ..... A63B 22/0694 482/62
2008/0085819 A1 * 4/2008 Yang ..... A63B 22/0605 482/62
2011/0275486 A1 * 11/2011 Hsu ..... A63B 22/0015 482/57
2015/0328496 A1 * 11/2015 Eder ..... A63B 22/0046 482/62
2018/0140949 A1 * 5/2018 Youn ..... A63B 22/0605
2018/0154204 A1 * 6/2018 Bayerlein ..... A63B 22/0005
2018/0228682 A1 * 8/2018 Bayerlein ..... A61H 1/0274
2018/0272184 A1 * 9/2018 Vassilaros ..... B62M 3/02

* cited by examiner

HUMAN POWERED STRENGTHENING MACHINE

BRIEF DESCRIPTION OF THE DRAWINGS

Other objects and features of the present invention will become apparent from the following detailed description considered in connection with the accompanying drawings. It should be understood however that the drawings are designed for the purpose of illustration only and not as a definition of the limits of the invention.

DETAILED DESCRIPTION OF PREFERRED EMBODIMENTS

Figure 1:
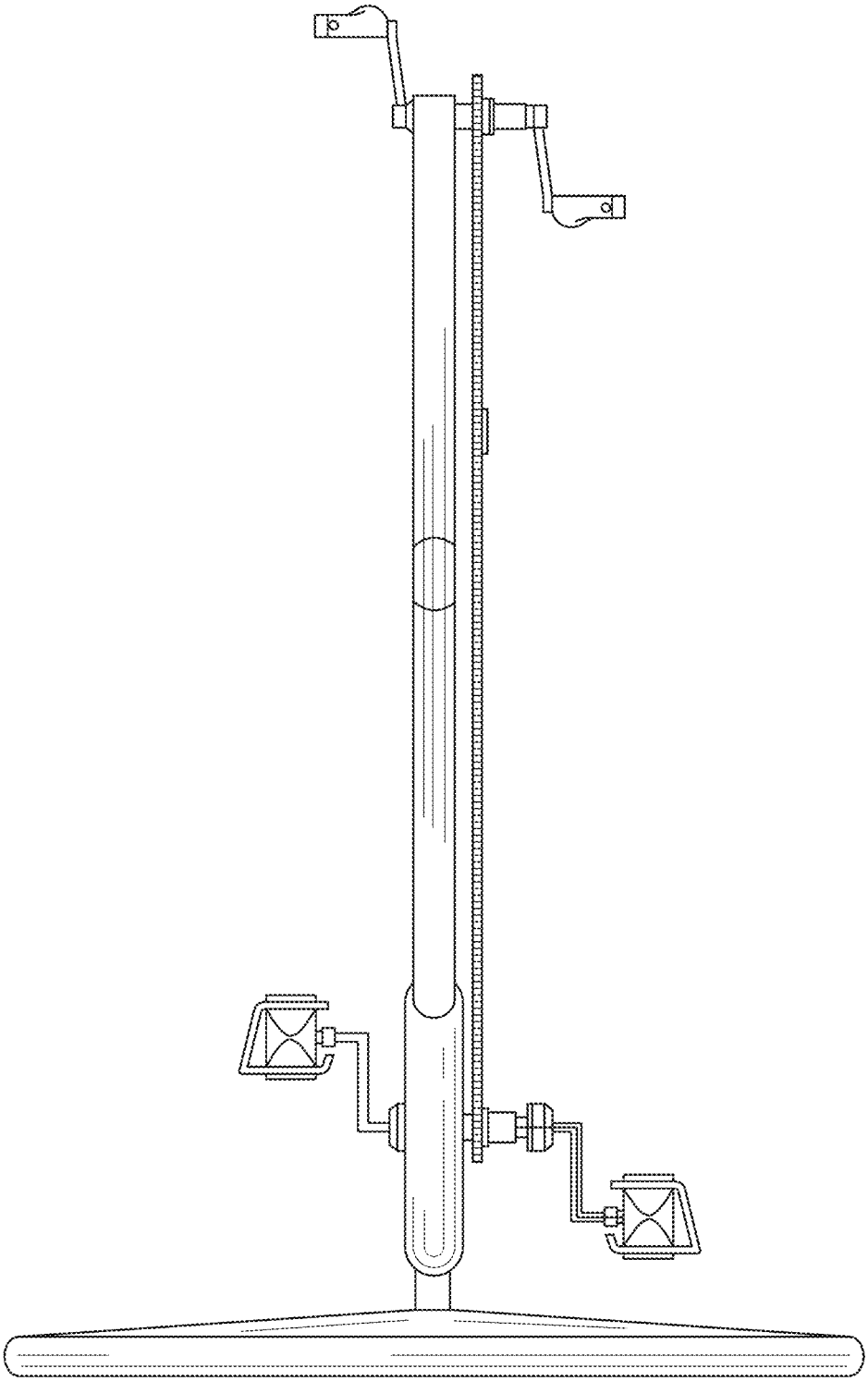
FIG. 1 is a front view of an example of an embodiment of the invention relating to an exercise machine.

Turning now in detail to the drawings FIG. 1 shows a front view of an example of the invention for a first embodiment of the device. In this first embodiment is shown an oval base 1, with a cross spreader bar 3. A center stem 2 is angled and is coupled with a limited-range pivot 4. On the base there can also be a plurality of caster wheels 16. There can be a drive system which can include gearing 6*a* and pedals 11, 12,13, 14, wherein the gearing or drive system is coupled to or supported by the angled center stem 2*a*, 2*b*. Pedals number 11 through 14 can include a pedal 11 or an additional pedal 12. There can also be other pedals such as pedal 13*b* or pedal 14*b* which can also comprise pedals 11 through 14.

There can also be a resistance control system 15*a*, 15*b*, which can be in the form of a lever on with a brake pad with hand control 15*b*, that can be coupled to the rotor casing 5*a* that can be coupled to the center stem 2.

To support these components entire frame includes a plurality of different support elements FIG. 1 which shows the frame can include an oval 1, with spreader bar 3 crossing off-center joining the long sides of the oval and supporting a limited-range pivoting stem couplings 4.

Figure 3:
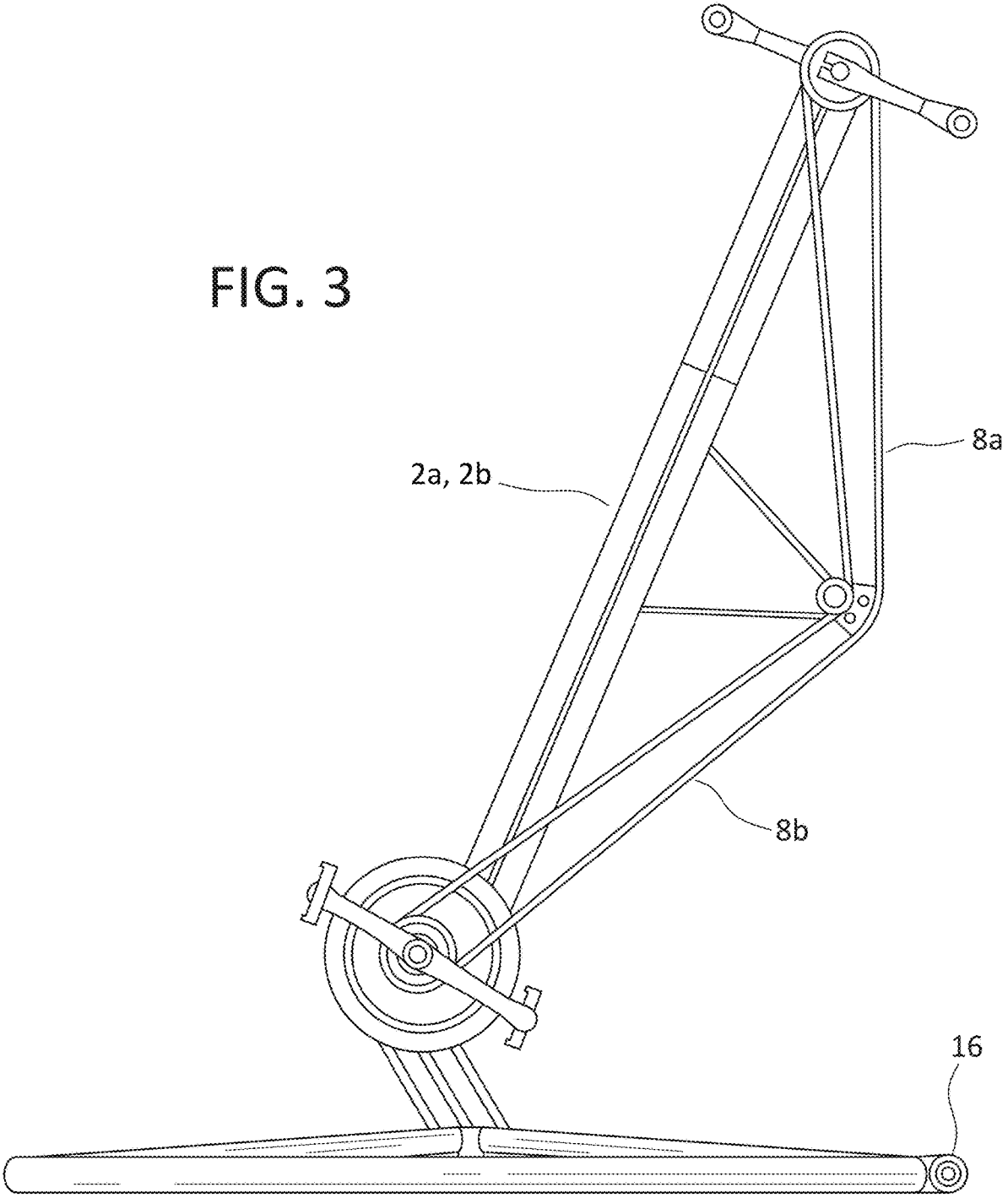
FIG. 3 is a side view of the embodiment shown in FIG. 1.

FIG. 3 shows the center stem 2 can include a plurality of additional support that can be used to support the drive mechanism and gearing 6*a*. The additional supports can include rotor casings 5*a*, 5*b* which support sprockets 7*a*, 7*b* and also rotatively support pedals 11 through 14 and guide tensioner wheels which can be used to guide a synchronizing belt 10 through and around the sprockets 7*a*, 7*b*.

Belts or linkages maybe coupled to the sprockets and used to drive a flywheel 9 and thus as sprocket 7*a* and 7*b* are driven by pedals 11*a* and 13*b* or as sprockets 7*a* and 7*b* are driven by pedals 12*a* and 14*b* this drives a respective belt (s) and (10) which mesh with respective sprockets and create exercise through driving pedals.

Belts may be guided between sprockets via adjustable guides. Adjustable guides may include rotating sprocket guides and adjustable arms 8*a*, 8*b*. For example, there are adjustable arms 8*a*, 8*b*, which hold a belt guide wheel or, pulley or pulleys. And there is an adjustable arm that holds each pedal. The angled center stem 2 may also be adjustable wherein there is an outer sleeve 2*b* around a telescoping center 2*a*, 2*b*, or jointed as in FIG. 3.

Figure 2:
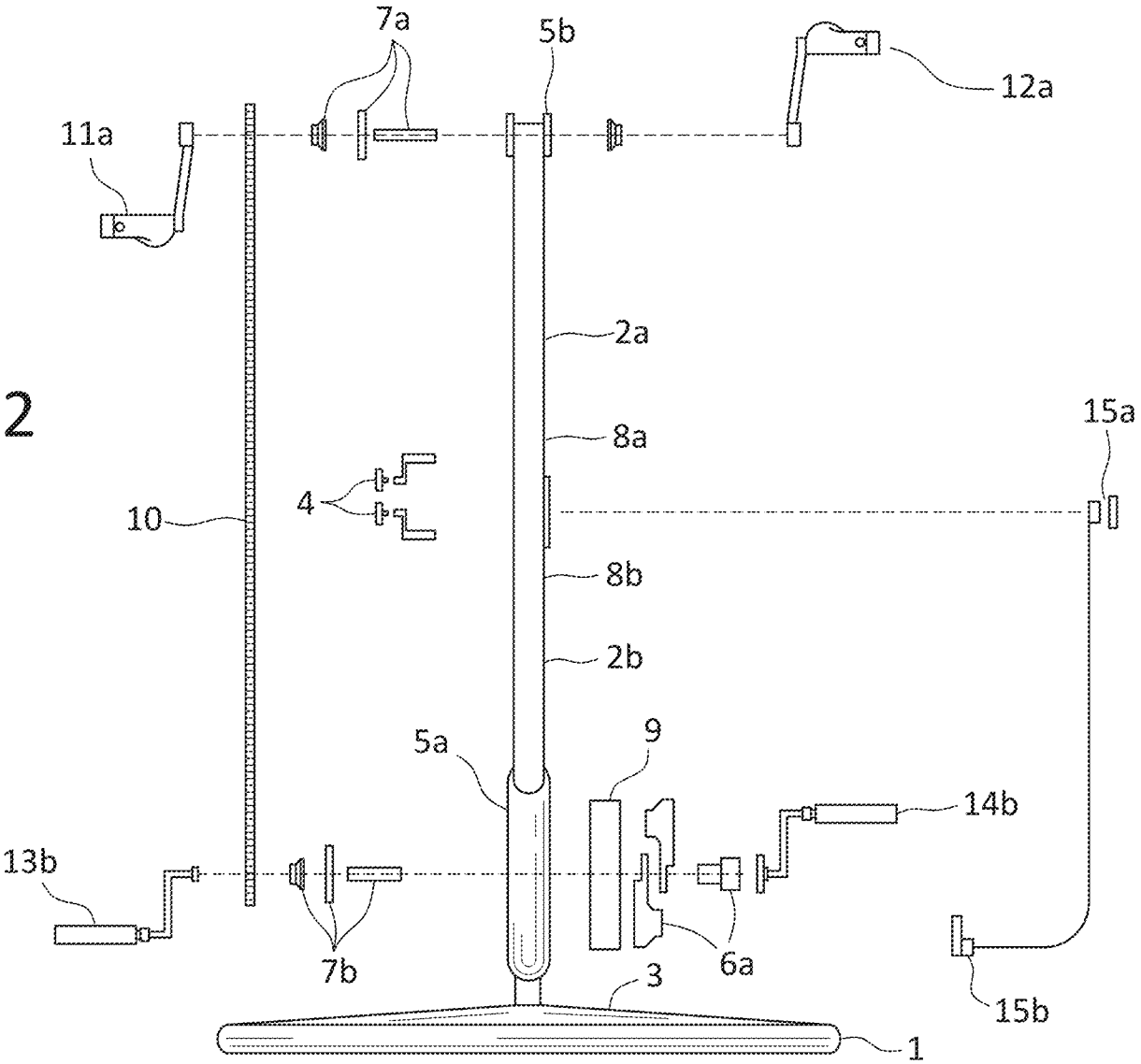
FIG. 2 is an exploded front view of the embodiment shown in FIG. 1.

The adjustability can occur when these arms are rotated about central connection point on the frame for when the telescoping members 2*a* and 2*b* are pulled apart as shown in FIG. 2. This adjustability can then lead to a tightening of the belt to keep the proper tension in this belt.

FIG. 2 shows and explodes the view wherein the view shows a lever arm brake 15*a*, 15*b* coupled to rotor casings 5*a*. With the respective cable where in turning the knob 15 *a* on the cable will increase resistance on driving the pedals.

Accordingly, while a few embodiments of the present invention have been shown and described, it is to be understood that many changes and modifications maybe made thereunto without departing from the spirit and scope of the invention as defined in the appended claims.

Figure 3A:
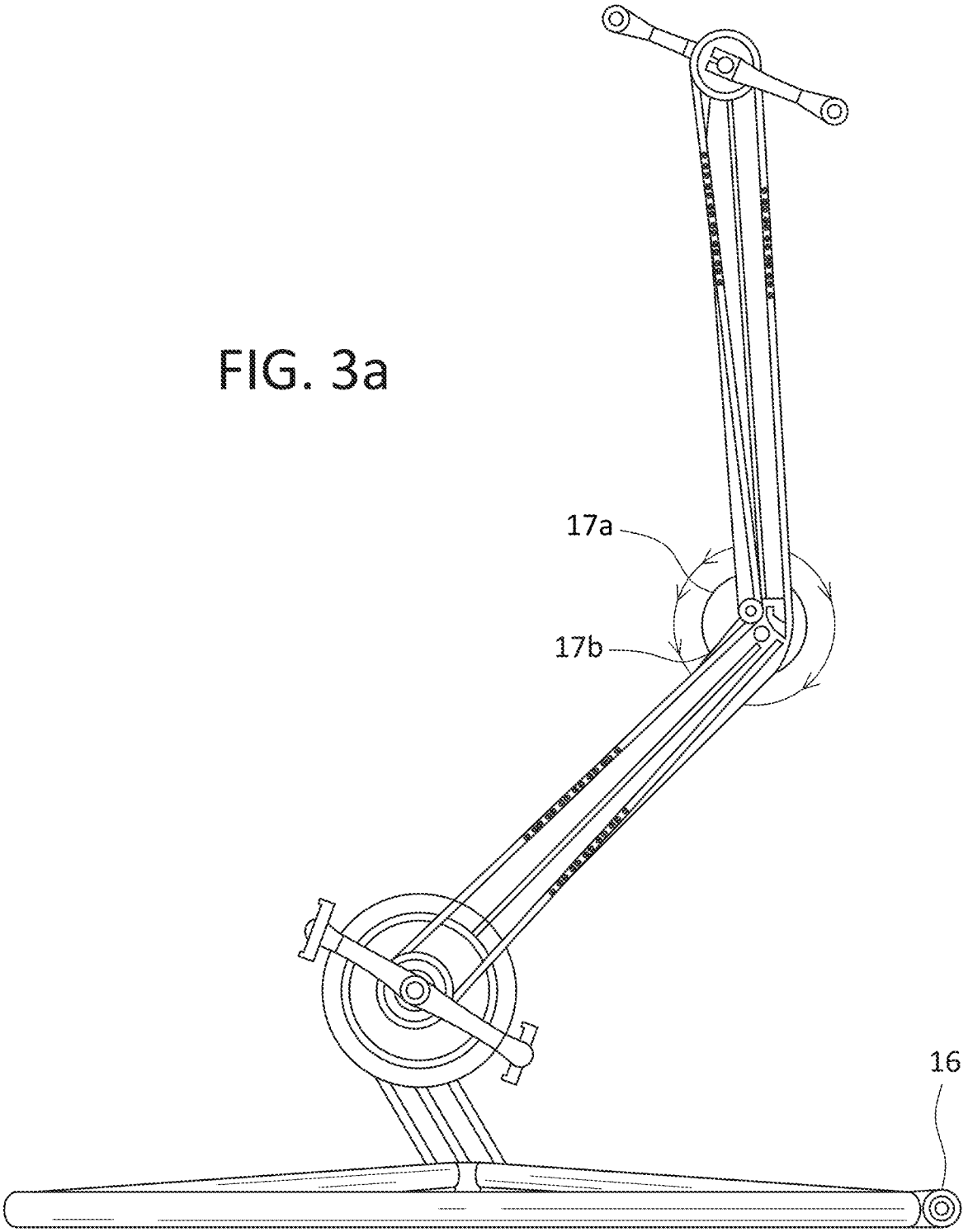
FIG. 3*a* is a side view of an example of another embodiment of the invention relating to an exercise machine.
Figure 4:
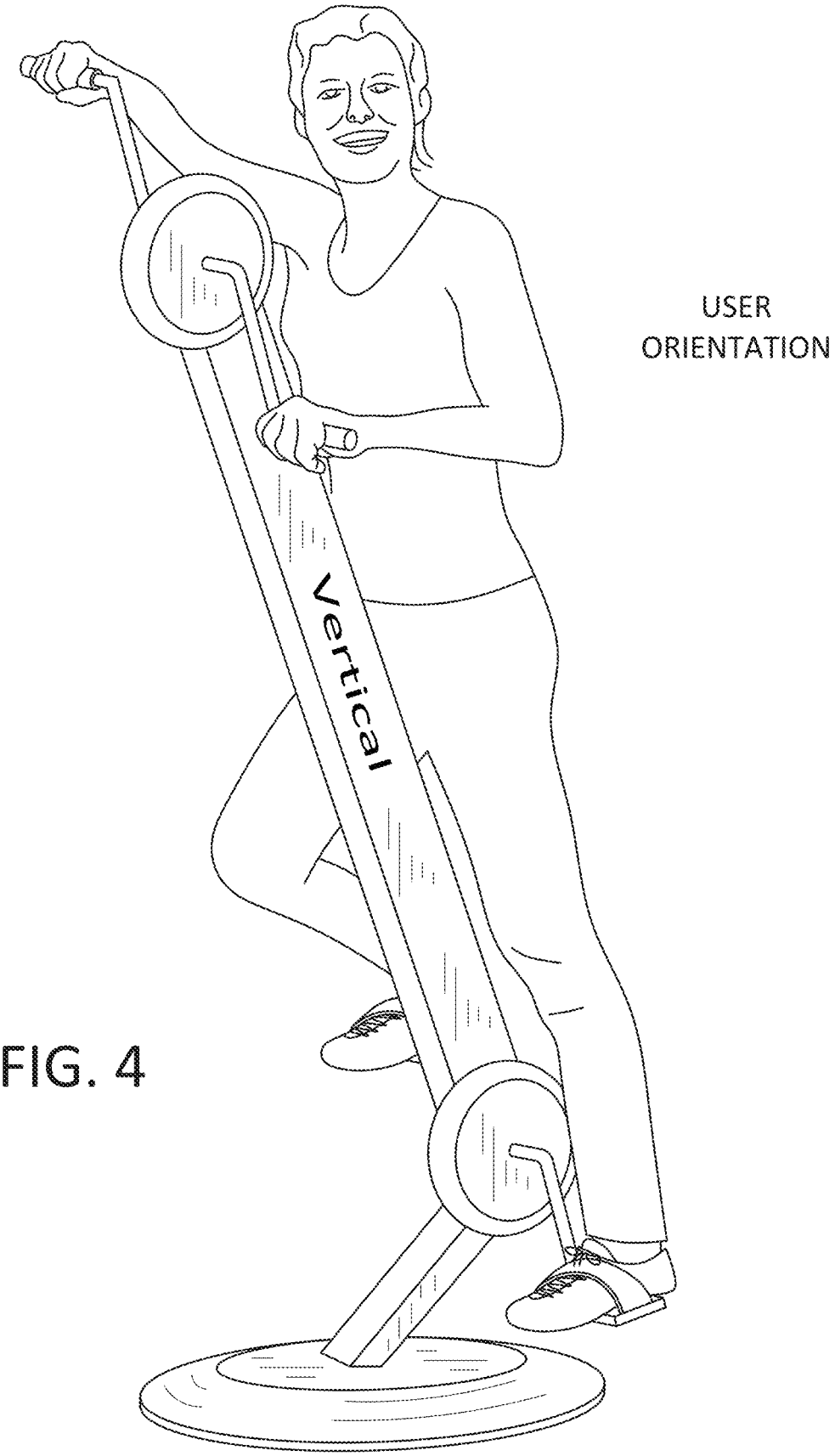
FIG. 4. is user orientation.

FIG. 3*a* shows how the Center Stem (2*a*, 2*b*) can be jointed in the middle with interlocking hinge (17*a*, 17*b*) for height adjustability.

The invention claimed is:

1. A standing exercise device, comprising:

a horizontally extending base;

a foot pedal assembly mounted to the base above the base, the foot pedal assembly including a pair of foot pedals configured for circular rotation by a pair of feet of a user;

a first adjustable arm having a first end pivotally coupled to the foot pedal assembly, the first adjustable arm extending upwardly from the first end thereof, at an angle relative to the base, to a second end;

a second adjustable arm having a first end and a second end, the first end of the second adjustable arm coupled to the second end of the first adjustable arm, the second adjustable arm extending upwardly from and at an angle relative to the first adjustable arm;

a hand pedal assembly mounted to the second end of the second adjustable arm, the hand pedal assembly including a pair of hand pedals configured for circular rotation, by a pair of hands of the user, in synchronization with the circular rotation of the pair of foot pedals;

a third member having a first end mounted to the foot pedal assembly, and a second end coupled to the hand pedal assembly, the third member extending at an angle relative to the base; and an interlocking hinge pivotally connecting the second end of the first adjustable arm and the first end of the second adjustable arm, wherein the first adjustable arm and the second adjustable arm are rotatable about the interlocking hinge to vertically adjust a position of the hand pedal assembly relative to the foot pedal assembly, and wherein the first adjustable arm and the second adjustable arm, and the third member together form a triangle-shaped adjustable frame defining a space configured to receive and support the user in a standing position with the hands and feet of the user respectively engaging and driving the pair of hand pedals and the pair of foot pedals in the synchronous circular motion.

2. The standing exercise device of claim 1, wherein the interlocking hinge, the second end of the first adjustable arm, and the first end of the second adjustable arm are configured for arcuate movement relative to the foot pedal assembly.

3. The standing exercise device of claim 2, wherein the arcuate movement relative to the foot pedal assembly is defined by a length of the first adjustable arm.

4. The standing exercise device of claim 1, wherein the first and second adjustable arms and the interlocking hinge all pass through a first plane, and the third member passes through a second plane offset from the first plane.

5. The standing exercise device of claim 1, further comprising:

a linkage for synchronizing at least one of the hand pedals with at least one of the foot pedals.

6. The standing exercise device of claim 1, further comprising:

a flywheel mechanically coupled to the foot pedal assembly.

7. The standing exercise device of claim 1, wherein the hand pedal assembly includes a left hand pedal and a right hand pedal, the foot pedal assembly includes a left foot pedal and a right foot pedal, and the synchronization of the circular motion of the hand pedals and the foot pedals includes maintaining the left hand pedal and the left foot pedal in a first corresponding rotative position, and the right hand pedal and the right foot pedal in a second corresponding rotative position.

8. The standing exercise device of claim 1, wherein the hand pedal assembly allows for circular motion of the hand pedals above and below a head of the user in the standing position.

9. The standing exercise device of claim 1, wherein the foot pedal assembly includes a rotor.

10. The standing exercise device of claim 1, wherein the first adjustable arm and the third member both extend upwardly in a forward direction from the foot pedal assembly, and the second adjustable arm extends upwardly in a rearward direction from the first adjustable arm.

11. The standing exercise device of claim 1, wherein the foot pedal assembly is positioned rearward of the hand pedal assembly.

12. The standing exercise device of claim 1, wherein the third member connects to the foot pedal assembly at an angle.

13. The standing exercise device of claim 1, wherein the pair of hand pedals and the pair of foot pedals rotate about respective axes parallel to the base.

14. The standing exercise device of claim 1, wherein each of the third member comprises a telescoping member and vertically adjusting the position of the hand pedal assembly relative to the foot pedal assembly occurs when the telescoping members are pulled apart.

15. The standing exercise device of claim 1, wherein the foot pedal assembly further comprises a support sprocket rotatably support the foot pedals.

* * * * *